US007229209B2

(12) United States Patent
Mo

(10) Patent No.: US 7,229,209 B2
(45) Date of Patent: Jun. 12, 2007

(54) PENDULUM BOX FOR CLOCK

(75) Inventor: Shanker Mo, Taichung Hsien (TW)

(73) Assignee: Centre Clock Industry Co., Ltd, Wu-Chi Town ( * ) Notice: Subject to any disclaimer, the term of this patent is extended or adjusted under 35 U.S.C. 154(b) by 250 days.

(21) Appl. No.: 11/008,548

(22) Filed: Dec. 9, 2004

(65) Prior Publication Data

US 2006/0126441 A1 Jun. 15, 2006

(51) Int. Cl.
*G04B 17/02* (2006.01)

(52) U.S. Cl. ..... 368/179; 368/134; 368/165

(58) Field of Classification Search ..... 368/134–138, 368/165–166, 179–183; 33/391; 40/485
See application file for complete search history.

(56) References Cited

U.S. PATENT DOCUMENTS 2,323,796 A * 7/1943 Cole ..... 368/166
3,546,874 A * 12/1970 Jauch et al. ..... 368/179
3,762,155 A * 10/1973 Marble ..... 368/10

* cited by examiner

*Primary Examiner*—Vit Miska
*Assistant Examiner*—Sean Kayes
(74) *Attorney, Agent, or Firm*—Alan Kamrath; Kamrath & Associates P.A.

(57) ABSTRACT

A pendulum box for a clock pendulum box includes a tumbler seat, a pendulum mover pivotally mounted on the tumbler seat, and a pendulum rod mounted on the pendulum mover and having a portion secured in the pendulum mover to move therewith. Thus, the pendulum rod is combined with the pendulum mover closely, so that the pendulum rod is moved with the pendulum mover synchronously. In addition, the pendulum rod is combined with the pendulum mover rigidly and stably, thereby preventing the pendulum rod from producing vibration or sway during movement.

11 Claims, 6 Drawing Sheets

PENDULUM BOX FOR CLOCK

BACKGROUND OF THE INVENTION

1. Field of the Invention

The present invention relates to a pendulum box, and more particularly to a pendulum box for a clock.

2. Description of the Related Art

A conventional pendulum box for a clock in accordance with the prior art shown in FIGS. 3 and 4 comprises a tumbler seat 1 having a lower end provided with a receiving case 2 to receive an electromagnetic coil (not shown) and a circuit board (not shown), a pendulum mover 3 having an upper end pivotally mounted on an upper end of the tumbler seat 1 and a lower end provided with a fixing seat 31 for fixing a magnet 311 and formed with a snap hole 33, a pendulum rod 32 pivotally mounted on the pendulum mover 3 and having an upper end snapped into the snap hole 33 of the pendulum mover 3, and a cover 11 mounted on the tumbler seat 1 to cover the pendulum mover 3. The tumbler seat 1 is used to rotate hour, minute and second hands (not shown) of the clock. The fixing seat 31 of the pendulum mover 3 is located adjacent to the receiving case 2 of the tumbler seat 1. Thus, when the magnetic field of the electromagnetic coil in the receiving case 2 of the tumbler seat 1 is changed, a force is produced between the magnet 311 of the pendulum mover 3 and the electromagnetic coil of the tumbler seat 1 so as to push the pendulum mover 3 to oscillate so as to move the pendulum rod 32.

However, the upper end of the pendulum mover 3 is pivotally mounted on the upper end of the tumbler seat 1, and the pivot connection of the pendulum mover 3 and the tumbler seat 1 is not located at the balance point of the pendulum mover 3, so that the pendulum mover 3 is oscillated too rapid, thereby decreasing stability of oscillation of the pendulum mover 3 and the pendulum rod 32. In addition, the upper end of the pendulum rod 32 is snapped into the snap hole 33 of the pendulum mover 3, so that the pendulum rod 32 is not combined with the pendulum mover 3 rigidly and stably. Thus, the pendulum rod 32 is easily vibrated or detached from the pendulum mover 3 during movement.

Another conventional pendulum box for a clock in accordance with the prior art shown in FIGS. 5–7 comprises a tumbler seat 41 having a lower end provided with a receiving case 42 to receive an electromagnetic coil (not shown) and a circuit board (not shown), a pendulum mover 43 having an upper end pivotally mounted on an upper end of the tumbler seat 41 and formed with a protruding stud 431 and a lower end provided with a fixing seat 44 for fixing a magnet (not shown) and formed with a snap hole 433, an upper pendulum rod 45 having a lower end secured on the protruding stud 431 of the pendulum mover 43, a lower pendulum rod 432 pivotally mounted on the pendulum mover 43 and having an upper end snapped into the snap hole 433 of the pendulum mover 43, and a cover 46 mounted on the tumbler seat 41 to cover the pendulum mover 43. The upper pendulum rod 45 provides a balance effect, so that the lower pendulum rod 432 is oscillated smoothly and stably.

However, the upper end of the lower pendulum rod 432 is snapped into the snap hole 433 of the pendulum mover 43, so that the lower pendulum rod 432 is not combined with the pendulum mover 43 rigidly and stably. Thus, the lower pendulum rod 432 is easily vibrated or detached from the pendulum mover 43 during movement.

SUMMARY OF THE INVENTION

In accordance with the present invention, there is provided a pendulum box, comprising:

a tumbler seat;

a pendulum mover pivotally mounted on the tumbler seat;

a pendulum rod mounted on the pendulum mover and having a portion secured in the pendulum mover to move therewith.

The primary objective of the present invention is to provide a pendulum box that is operated exactly.

Another objective of the present invention is to provide a pendulum box, wherein the pendulum rod is combined with the pendulum mover closely, so that the pendulum rod is moved with the pendulum mover synchronously.

A further objective of the present invention is to provide a pendulum box, wherein the pendulum rod is combined with the pendulum mover rigidly and stably, thereby preventing the pendulum rod from producing vibration or sway during movement.

A further objective of the present invention is to provide a pendulum box, wherein the pendulum rod is combined with the pendulum mover integrally, thereby preventing the pendulum rod from detaching from the pendulum mover.

Further benefits and advantages of the present invention will become apparent after a careful reading of the detailed description with appropriate reference to the accompanying drawings.

DETAILED DESCRIPTION OF THE INVENTION

Figure 1:
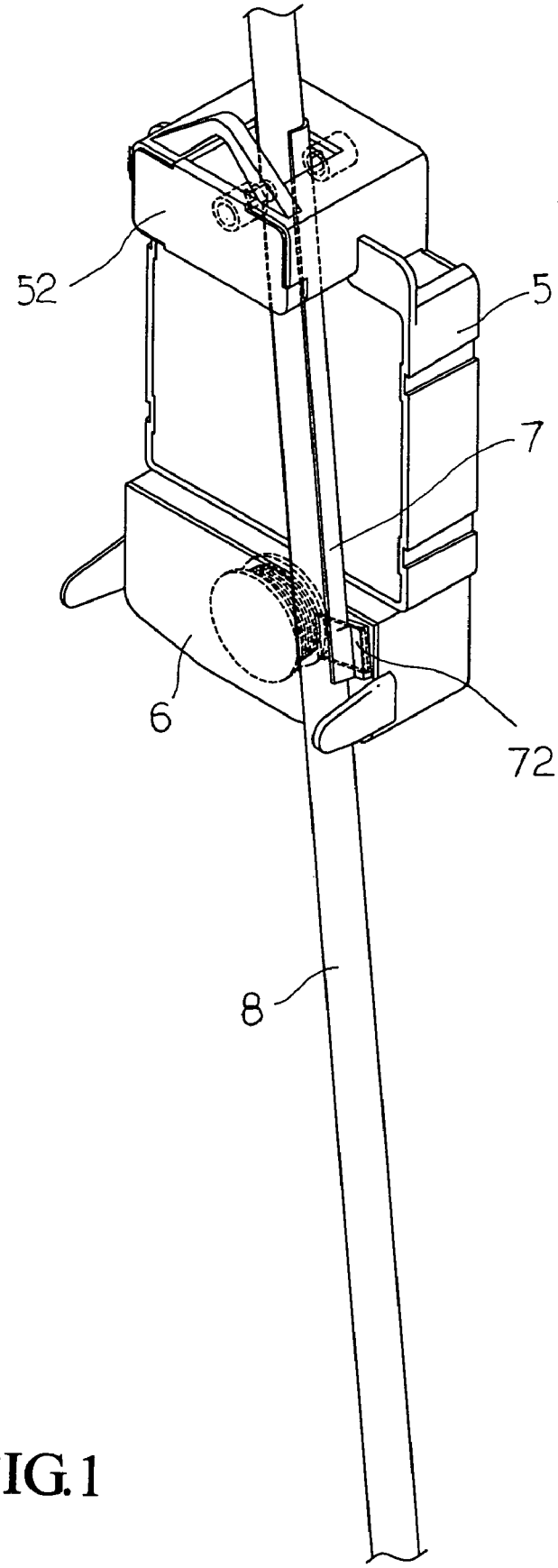
FIG. 1 is a partially cut-away perspective view of a pendulum box for a clock in accordance with the preferred embodiment of the present invention.
Figure 2:
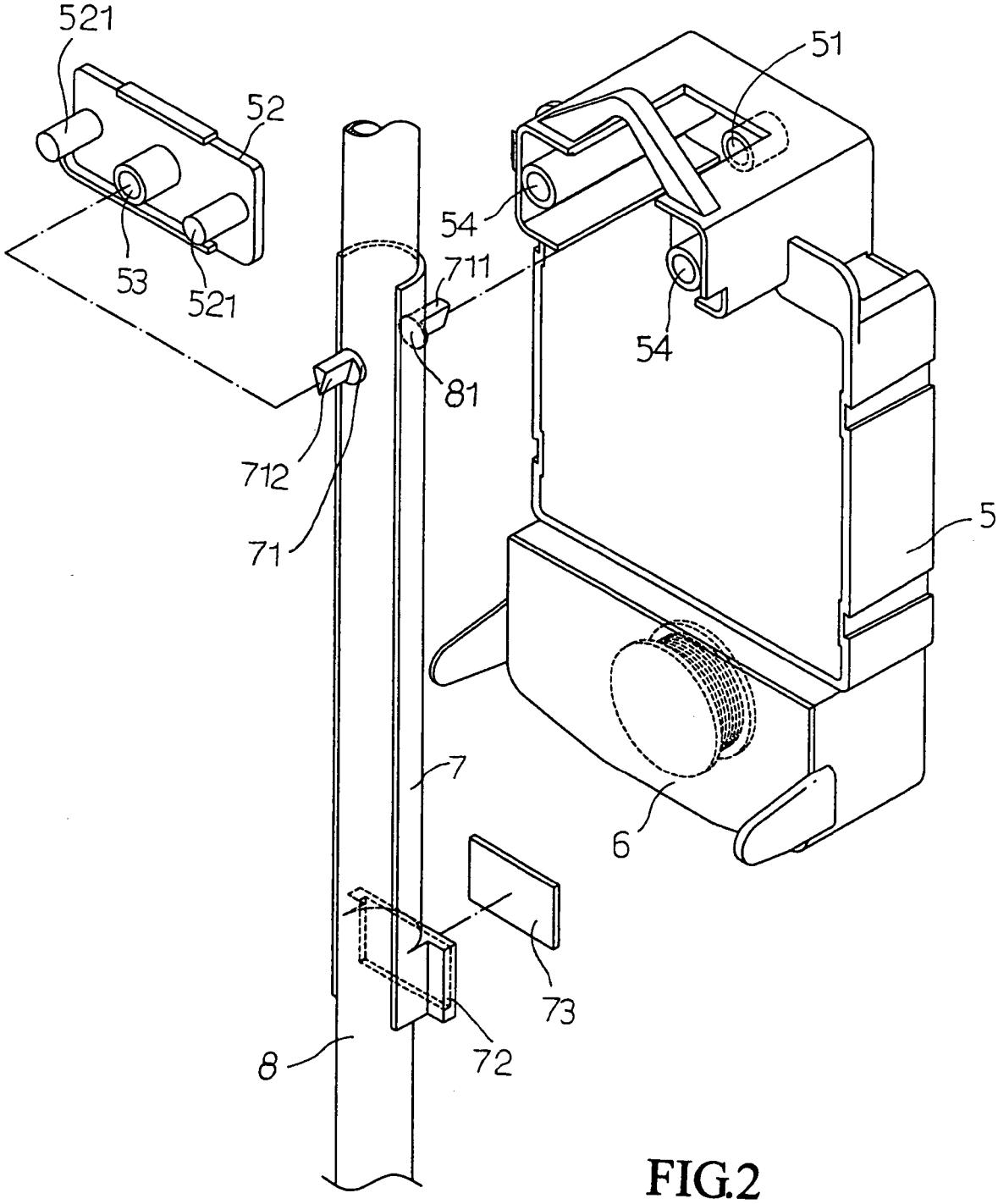
FIG. 2 is an exploded perspective view of the pendulum box as shown in FIG. 1.
Figure 3:
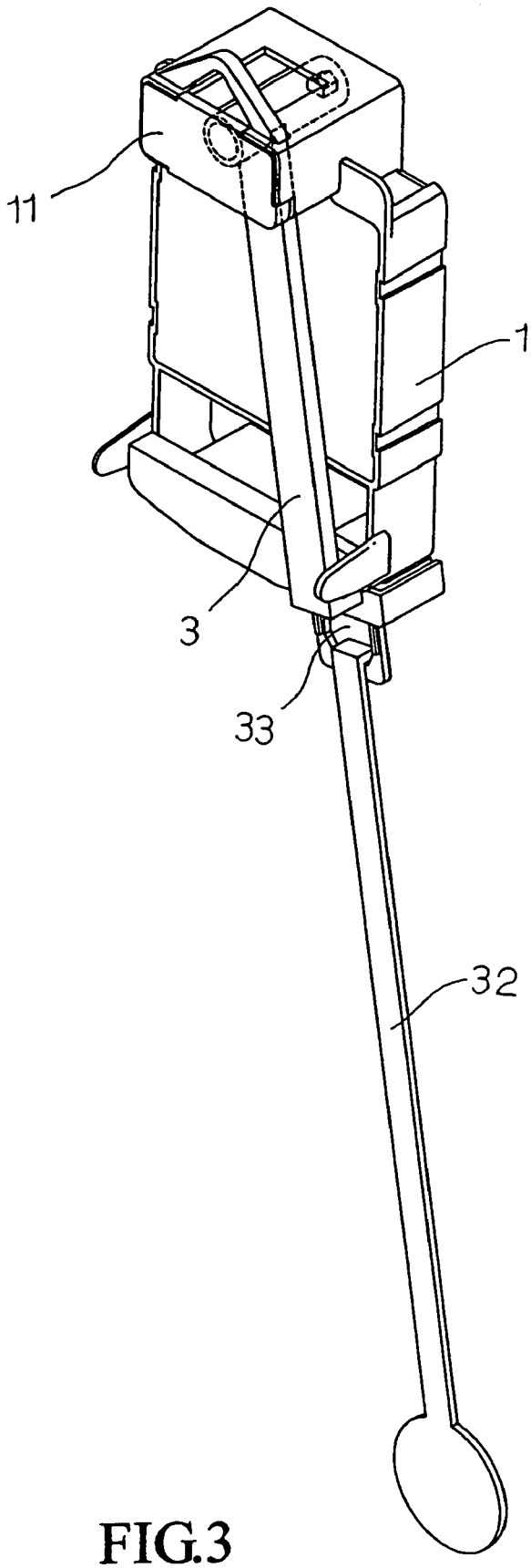
FIG.3 PRIOR ART
FIG. 3 is a perspective view of a conventional pendulum box for a clock in accordance with the prior art.
Figure 4:
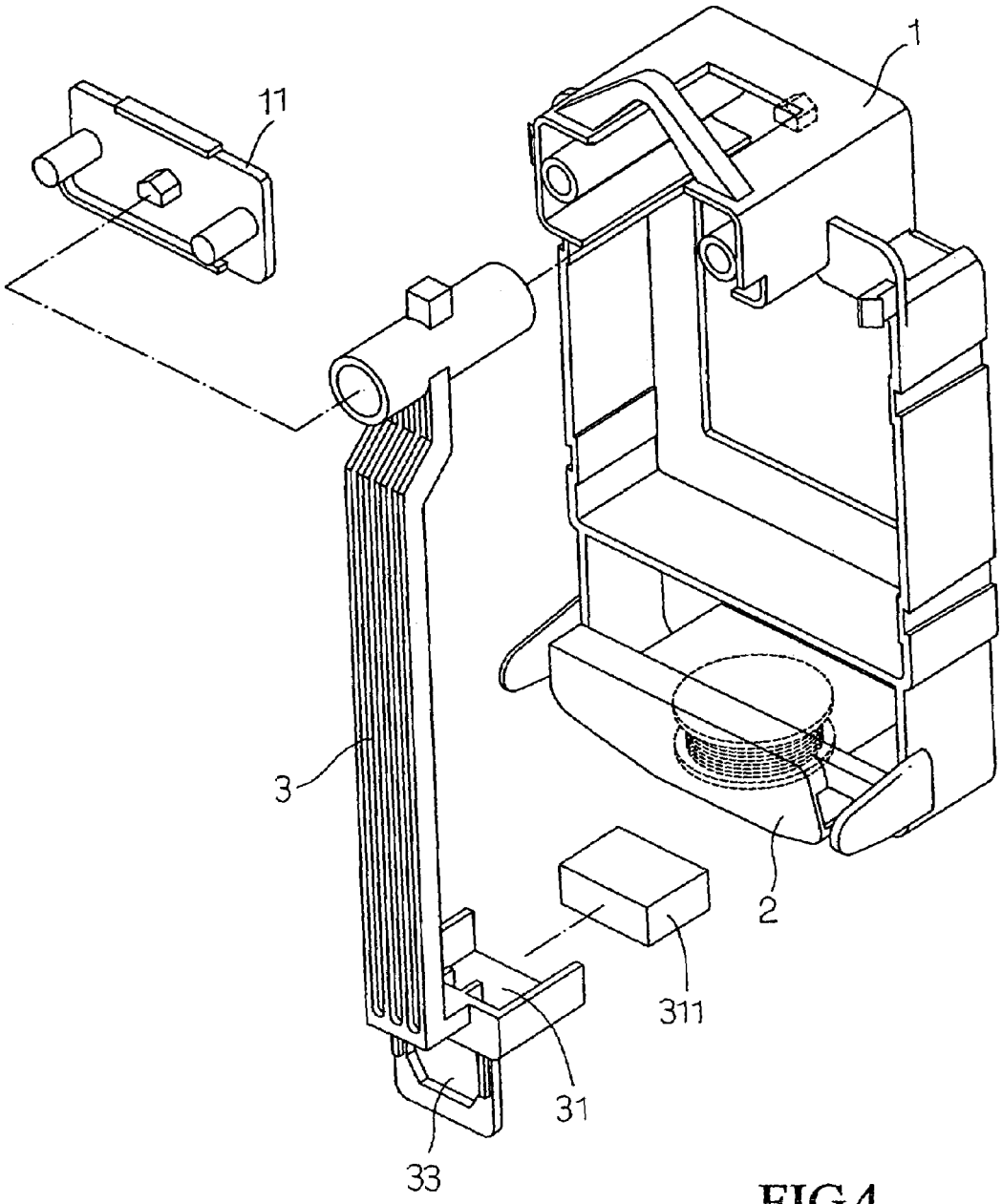
FIG.4 PRIOR ART
FIG. 4 is an exploded perspective view of the conventional pendulum box as shown in FIG. 3.
Figures 5, 7:
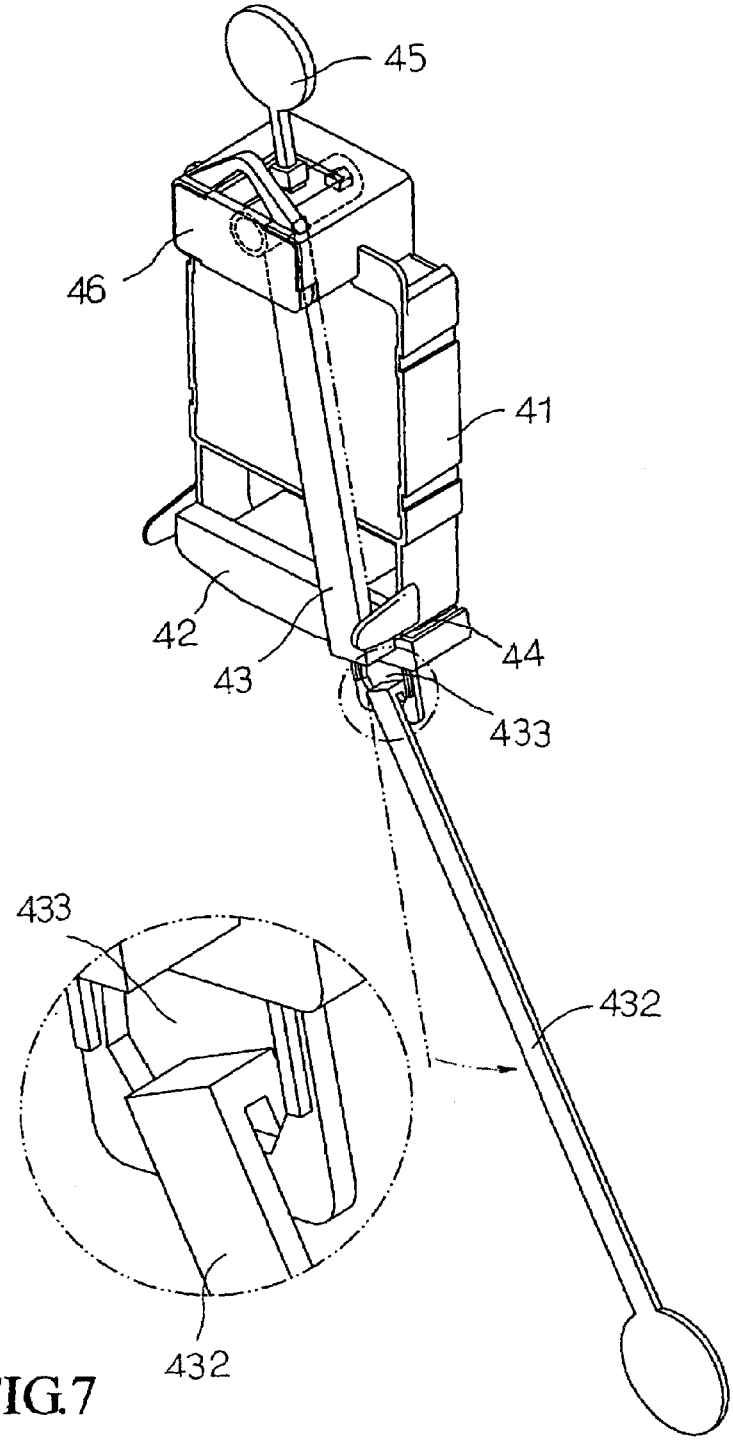
FIG.5 PRIOR ART
FIG.7 PRIOR ART
FIG. 5 is a perspective view of another conventional pendulum box for a clock in accordance with the prior art.
FIG. 7 is a locally enlarged view of the conventional pendulum box as shown in FIG. 5.
Figure 6:
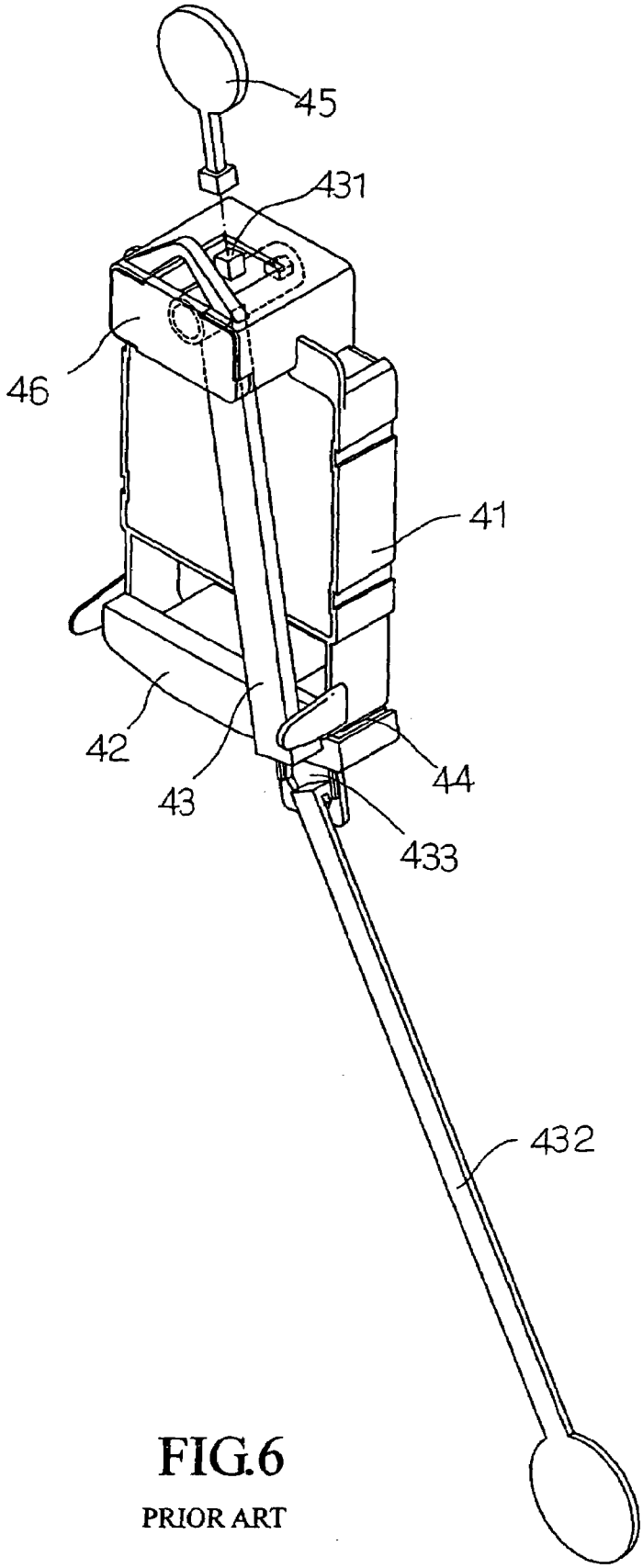
FIG.6 PRIOR ART
FIG. 6 is a partially exploded perspective view of the conventional pendulum box as shown in FIG. 5.

Referring to FIGS. 1 and 2, a pendulum box for a clock in accordance with the preferred embodiment of the present invention comprises a tumbler seat 5, a pendulum mover 7 pivotally mounted on the tumbler seat 5, a pendulum rod 8 mounted on the pendulum mover 7 and having a portion secured in the pendulum mover 7 to move therewith, and a cover 52 mounted on the tumbler seat 5 and enclosed around the pendulum rod 8 to retain the pendulum rod 8 and the pendulum mover 7 in the tumbler seat 5.

The tumbler seat 5 is used to rotate hour, minute and second hands (not shown) of the clock and has all upper end formed with two opposite fixing holes 54 and a pivot hole 51 located between the two fixing holes 54, and a lower end provided with a receiving case 6 to receive an electromagnetic coil (not shown) and a circuit board (not shown).

The cover 52 has a side formed with two opposite fixing posts 521 each inserted into a respective one of the two fixing holes 54 of the tumbler seat 5 and a pivot hole 53 located between the two fixing posts 521.

The pendulum mover 7 has an upper end pivotally mounted on the upper end of the tumbler seat 5 and a lower end provided with a fixing seat 72 for fixing a magnet 73. The fixing seat 72 of the pendulum mover 7 is located adjacent to the receiving case 6 of the tumbler seat 5. Thus, when the magnetic field of the electromagnetic coil in the receiving case 6 of the tumbler seat 5 is changed, a force is produced between the magnet 73 of the pendulum mover 7 and the electromagnetic coil of the tumbler seat 5 to push the pendulum mover 7 to oscillate so as to move the pendulum rod 8.

The pendulum mover 7 is hollow and has a semi-cylindrical shape. The pendulum box further comprises a locking post 71 extended through the pendulum mover 7 and the pendulum rod 8, so that the pendulum rod 8 is fixed in the pendulum mover 7.

The pendulum rod 8 is extended through and fixed in an inside of the pendulum mover 7 and has an upper end formed with a through hole 81 to allow passage of the locking post 71.

Preferably, the locking post 71 is fixed on the pendulum mover 7 and has a first end 711 protruding outward from the upper end of the pendulum mover 7 and inserted into the pivot hole 51 of the tumbler seat 5 and a second end 712 protruding outward from the upper end of the pendulum rod 8 and inserted into the pivot hole 53 of the cover 52.

Accordingly, the pendulum rod 8 is combined with the pendulum mover 7 closely, so that the pendulum rod 8 is moved with the pendulum mover 7 synchronously. In addition, the pendulum rod 8 is combined with the pendulum mover 7 rigidly and stably, thereby preventing the pendulum rod 8 from producing vibration or sway during movement. Further, the pendulum rod 8 is combined with the pendulum mover 7 integrally, thereby preventing the pendulum rod 8 from detaching from the pendulum mover 7.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A pendulum box, comprising:

a tumbler seat;

a pendulum mover pivotally mounted on the tumbler seat;

a pendulum rod mounted on the pendulum mover and having a portion secured in the pendulum mover to move therewith;

wherein the pendulum mover has a semi-cylindrical shape.

2. The pendulum box in accordance with claim 1, wherein the pendulum mover is hollow.

3. The pendulum box in accordance with claim 1, wherein the pendulum rod is extended through and fixed in an inside of the pendulum mover.

4. The pendulum box in accordance with claim 1, further comprising a locking post extended through the pendulum mover and the pendulum rod, so that the pendulum rod is fixed in the pendulum mover.

5. The pendulum box in accordance with claim 4, wherein the pendulum rod has an upper end formed with a through hole to allow passage of the locking post.

6. The pendulum box in accordance with claim 4, wherein the locking post is fixed on the pendulum mover.

7. The pendulum box in accordance with claim 4, wherein the locking post has a first end protruding outward from an upper end of the pendulum mover and a second end protruding outward from an upper end of the pendulum rod.

8. The pendulum box in accordance with claim 7, wherein the tumbler seat has an upper end formed with a pivot hole, and the first end of the locking post is inserted into the pivot hole of the tumbler seat.

9. The pendulum box in accordance with claim 7, further comprising a cover mounted on the tumbler seat and enclosed around the pendulum rod to retain the pendulum rod and the pendulum mover in the tumbler seat, wherein the cover has a side formed with a pivot hole, and the second end of the locking post is inserted into the pivot hole of the cover.

10. The pendulum box in accordance with claim 1, wherein the pendulum rod is moved with the pendulum mover synchronously.

11. The pendulum box in accordance with claim 1, wherein the pendulum rod is combined with the pendulum mover integrally.

* * * * *